United States Patent [19]

Eales

[11] 4,071,329

[45] Jan. 31, 1978

[54] COAL GASIFICATION PLANT

[75] Inventor: David Frank Eales, Kinross, Scotland

[73] Assignee: British Gas Corporation, London, England

[21] Appl. No.: 743,901

[22] Filed: Nov. 22, 1976

[30] Foreign Application Priority Data

Nov. 27, 1975 United Kingdom ..... 48808/75

[51] Int. Cl.[2] ..... B01J 3/00

[52] U.S. Cl. ..... 48/62 R; 48/73; 48/77; 48/202; 48/DIG. 2; 110/28 P; 432/14

[58] Field of Search ..... 48/77, 73, 76, 62 R, 48/92, 63, 202, 210, 197 R, DIG. 2; 110/28 P, 165 R; 122/235 N; 432/14

[56] References Cited

U.S. PATENT DOCUMENTS 3,437,561 4/1969 Squires ..... 48/77

FOREIGN PATENT DOCUMENTS 266,180 3/1966 Australia ..... 48/77

*Primary Examiner*—Robert L. Lindsay, Jr.
*Assistant Examiner*—George C. Yeung
*Attorney, Agent, or Firm*—Larson, Taylor and Hinds

[57] ABSTRACT

The quench chamber of a slagging pressure gasifier is provided with a perforated tubular air ring remote from the slag tap main burner of the gasifier and arranged, in use, to supply the burner with a secondary air supply and, at the same time, to set up an air circulation adjacent the walls of the chamber above the normal water level therein, thereby to cool the walls. There is further provided a nozzle mixing ring burner for use in a slagging gasifier comprising a body having two integrally formed chambers each having respectively a gas inlet and outlet and an air/oxygen inlet and outlet. The outlets are directed toward a shaped annular portion on the inner periphery of the ring body.

14 Claims, 5 Drawing Figures

Figure 1:
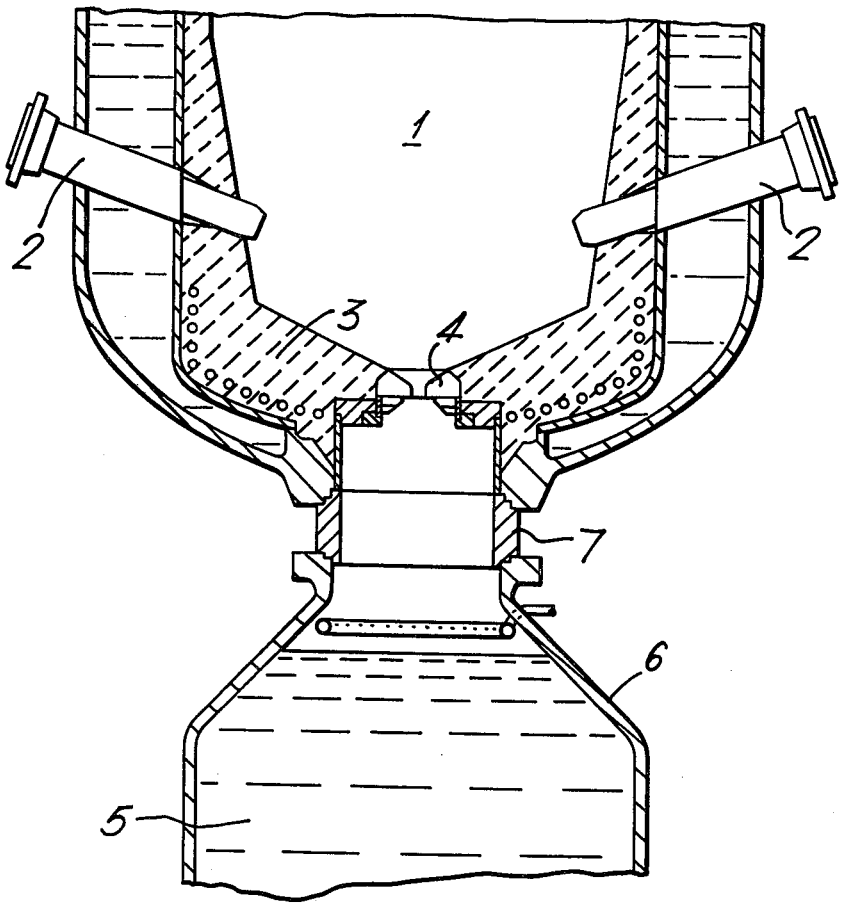

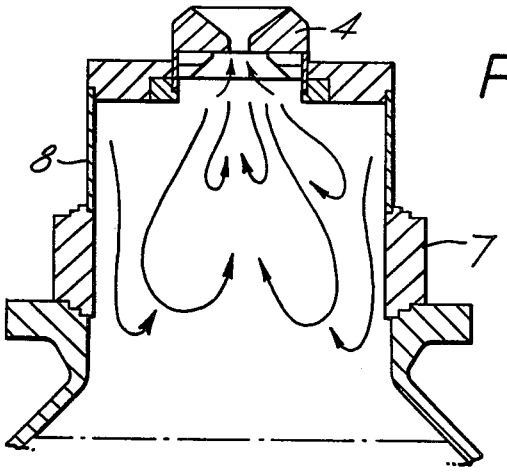
FIG.3.
FIG.4.
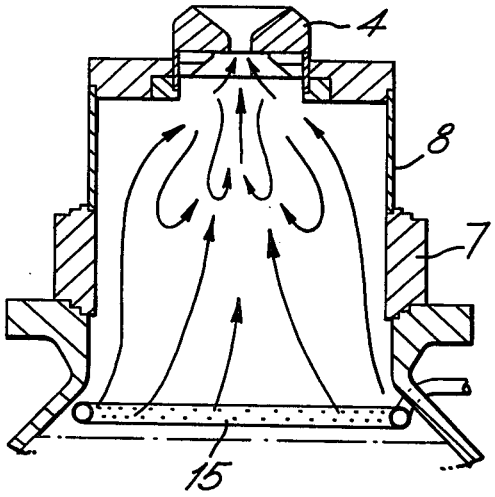
FIG.5.
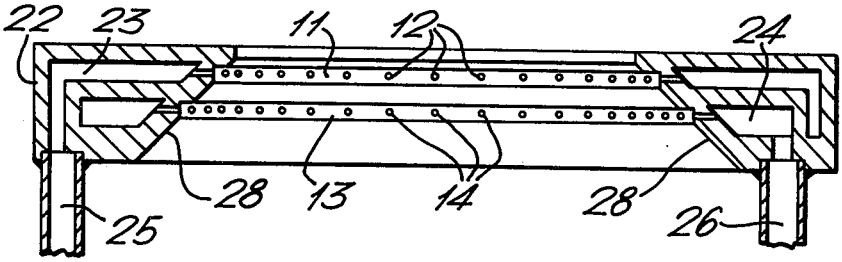

COAL GASIFICATION PLANT

This invention relates to coal gasification plant, and more particularly to a burner and quenching chamber arrangement for use in a slagging coal gasifier of the kind (hereinafter referred to as the kind specified) in which coal or other carbonaceous fuel is introduced into the top of a column-like gasifying vessel and is gasified under high pressure and temperature by means of oxygen and steam introduced near the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber. Usually, the pool of molten slag and iron is maintained in the hearth by directing hot combustion products from a burner located beneath the slag tap orifice up the tap orifice to retain the slag and iron in the hearth, the tapping of the moltenslag and iron being initiated and controlled by stopping or reducing the burner output and reducing the pressure in the quenching chamber by controlled venting to atmosphere through a venting system so as to produce a differential pressure between the quenching chamber and the gasifier vessel.

Examples of such slagging gasifier plant are those disclosed in United Kingdom Patent Specification No. 977,122, the Gas Council Research Communications No's GC 50 and GC 112.

Some forms of slag-tap burners designed for use in such gasifiers are of the tangential nozzle mix type, that is to say, of the kind in which combustible products are separately supplied to the burner and mixed externally of the burner parts to produce a stable flame.

Difficulties have been experienced in the upper regions of the quenching chamber above the water level using these forms of burners in that they tended to direct part of the flame downwards into the region above the water level causing overheating of the quenching chamber walls and other areas of the upper chamber.

Another difficulty experienced with such burners is that the combustion products from the burner, circulating above the water level before passing through the slag tap hole, bend to cool the products and, therefore, upon passing through the hole, cools the molten slag and forms solid slag within the tap.

An object of the present invention is to provide an improved quench chamber and burner arrangement less subject to the difficulties mentioned above.

According to the present invention in the operation of a coal slagging gasifier of the kind specified hereinbefore, wherein a burner is provided within the quench chamber adjacent the underside of the slag removal orifice, the improvement consisting of providing a combustion sustaining gas containing at least some of the oxygen required for combustion at the burner from a position within the chamber, above the level of water therein, and remote from the burner, whereby the flow path of the combustion sustaining gas is arranged to circulate in a space in the chamber between the slag tap and the water level and to provide a layer of gas intermediate of the walls of the chamber and the burner combustion gases.

It is an advantage to enable the burner to operate with the combustion-sustaining gas being supplied remote from the burner and wherein, preferably, the combustion sustaining gas containing from 10–90% of the oxygen required for combustion at the burner.

It is possible to operate the burner wherein the combustion sustaining gas is a mixture of carbon dioxide and oxygen or air and the gas is supplied at about ambient temperature.

Preferably, an apparatus for performing the operation includes a burner adjacent the underside of the slag removal orifice within the quench chamber, and means for supplying said combustion sustaining gas to the burner in a flow path which circulated the space in the chamber, said means being arranged within the chamber above the water level and remote from the burner.

It is an advantage for the combustion sustaining gas to travel along the entire length of the space between the water level and the slag tap and, therefore preferably, the combustion sustaining gas is supplied from positions adjacent the walls of the chamber and immediately above the water level.

Preferably, the combustion sustaining gas is supplied from a supply means which is a tubular annulus provided with a plurality of port holes equi-spaced around its surface.

Preferably also, the tubular annulus is located within and adjacent the wall of the chamber and above the water level.

During slag tapping operations it is desirable that the ring should not be fouled from the falling slag and, therefore preferably, the ring is shielded from falling slag during a tapping operation, during the operation of the gasifier.

Preferably the burner is a nozzle mixing ring type.

Also preferably, the burner comprises separate chambers for a fuel gas and for a primary air supply, each chamber having at least one inlet and a plurality of outlet ports arranged around the inner periphery of the ring.

And further, preferably, the inner periphery of the ring burner is provided with sloping walls through which said ports are formed, and arranged in use so that the fuel gas and the outlet supply are arranged to provide converging streams of fuel gas and primary air supply in the space defined by the ring.

Figure 2:
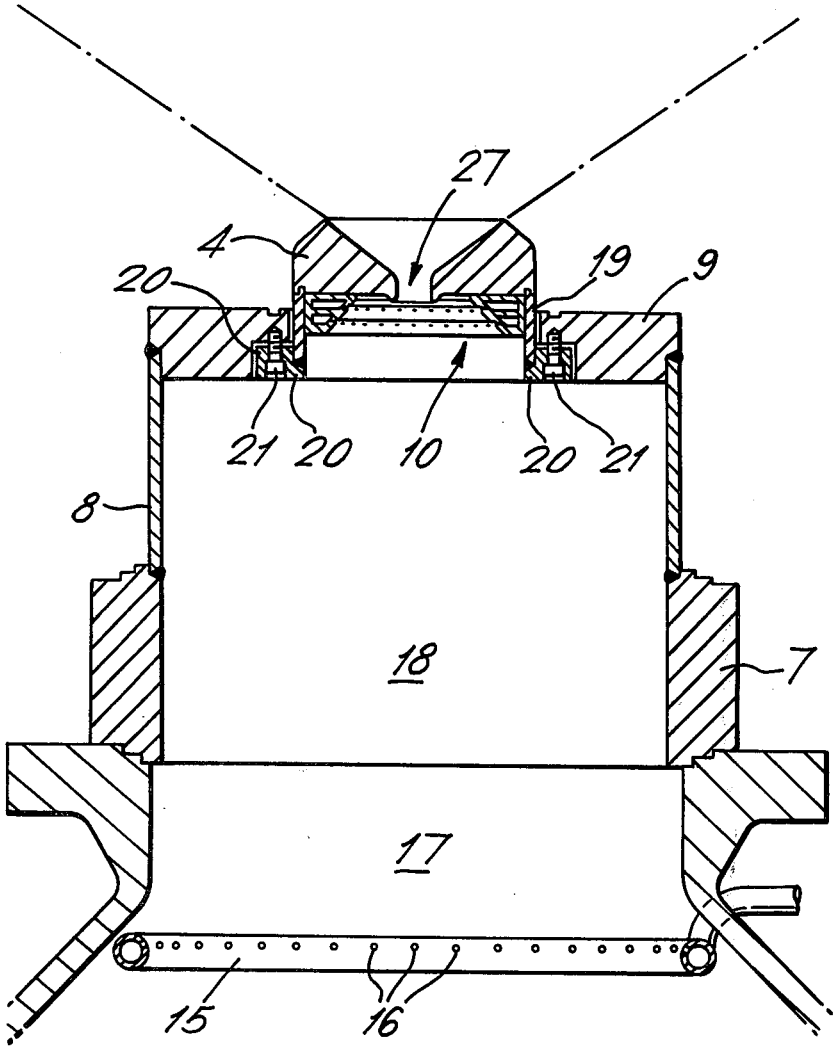

To enable the invention to be more clearly understood, and solely by way of example, one embodiment of the invention will be described with reference to the accompanying diagrammatic drawings, in which:

FIG. 1 is a general longitudinal sectional elevation of part of a slagging gasifier, FIG. 2 is an enlarged longitudinal sectional elevation of the upper region of the quenching chamber, FIGS. 3 and 4 are flow diagrams showing flow patterns of circulatory gases in the upper part of the quenching chamber, and, FIG. 5 is a side sectional elevation of the burner.

Referring first to FIG. 1, a gasifier has a refractory-lined pressurised gasification chamber 1 into which coal is fed from the top. Oxygen and steam are introduced into the chamber 1 through tuyeres 2 to promote gasification of the coal. In use of the gasifier, a pool of molten slag collects in a sloping hearth 3 and is periodically passed via a slag outlet or tap 4 into a water reservoir 5 contained in a quench chamber 6 where it is quenched before being transferred to a lock hopper (not shown) in the form of a dense small grained frit. The quench chamber 6 is attached to the bottom end of the gasification chamber 1 through the intermediary of a spacing member or sandwich flange 7.

Referring also to FIG. 2 and FIG. 5 a metal tube 8 is fixed to, and extends upwardly from, the flange 7 and is fixed at its upper end to an annular metal block 9 which supports a ring like burner 10 concentrically beneath the slag tap 4.

Preferably, the burner (to be described more fully later) is of the nozzle mixing ring type and consists generally of a gas ring 11 having gas outlets 12 and an air ring 13 having air outlets 14. The burner is supported by a metal ring 19 which includes a flange 20. The flange 20 (and therefore the rung 19) is removably secured to the metal block 9 by bolts 21.

In use of the gasifier, secondary combustion-sustaining gases or gas mixtures are supplied to the burner 10 from a tubular ring 15 having outlet ports 16 at any suitable equi-spaced positions around the ring. The flow path of these gases flow upwardly towards the burner 10 and produce flow paths as shown in FIG. 4. The gases or gas mixtures circulate around the upper part of the quench chamber 17 and region 18 which is the region defined by the sandwich flange 7 and metal tube 8.

Difficulties have previously been experienced in gasifiers in that part of the combustion products from the slag tap burner have moved down into the regions 17 and 18 and caused overheating of the walls surrounding the regions. This downward flow of part of the combustion products from the burner is shown in FIG. 3. In accordance with the invention the upward flow of gases and gas mixtures from the tubular ring 15 tends to restrict the downward flow of the combustion products from the burner and thus avoids, to a great extent, any heating of the walls surrounding the region 17 and 18. Furthermore, the gases flowing from the tubular ring 15 have a cooling effect upon these walls.

A preferred arrangement of the aforementioned slag tap burner 10 is shown in FIG. 5 and comprises a body 22 having annular gas and air passages 23 and 24, disposed one above the other which are respectively supplied with gas and air through inlets 25 and 26. An inner annular sloping wall 28 of the burner body 22 has a plurality of spaced gas and air outlets ports 12 and 14 formed in two arrays, one above the other, each array communicating with respective gas or air passages 23, 24. During slag tapping operations, slag falls through the slag tap orifice 27 and passes through the centre of the burner 10. Difficulties have occured in the past where the slag has fouled the burner and caused damage to it. The preferred nozzle mixing ring type burner described above have a sloping face 28 avoids the molten slag path and thus no fouling of the burner takes place.

A further advantage of the present invention is that the burner can be arranged to operate is separate modes so, that is to say it may be operated between gas rich and oxygen rich mixture conditions.

If the burner is operated on a gas mixture lacking in oxygen, carbon formation will take place and this is useful in that the flame can produce a carbon layer on the underside of the slag tap to form a protective coating which presents attack of the underside by the iron produced by the gasification process.

A still further advantage of the arrangement is that when the burner is in an oxygen enriched mode, the excess oxygen reacts with the carbon dissolved in the slag thus producing an exothermic reaction which increases the temperature of the molten products in the hearth. This obviously increases the activity of the reactionary constituents in the gasification process.

Another advantage of the arrangement is that when the burner is turned down prior to a slag tapping operation it is preferable that the primary air supplied from the air outlet ports 14 is reduced to a low limit and that the oxygen required to retain combustion at the burner 10 is supplied by the secondary combustion sustaining gas ring 15. The reason for this is that when the air is supplied to the burner from the primary air supply, it causes an excessive amount of thrust up through the slag orifice which results in dispersion of the slag stream during a slag tapping operation. If the oxygen is gas supply from the secondary supplied rings 15 this dispersion is very much reduced.

Another further advantage of the arrangement is that in a burner having oxygen supplied by a primary and secondary supply means, the flame from the burner shows more stability and is of a firmer appearance.

I claim:

1. In a coal slagging gasifier comprising: a column-like vessel; means for introducing coal or other carbonaceous fuel into the top of said vessel; tuyere means for introducing oxygen and steam into said vessel for gasification of fuel therein; a hearth for collecting molten slag and iron which is formed during gasification of the fuel, said hearth having a slag tap orifice for periodically discharging slag downwardly; a quenching chamber located below said slag tap orifice for quenching slag discharged through said slag tap orifice, said quenching chamber being constructed and arranged to hold a body of quenching liquid therein; a burner located within said quenching chamber for directing hot combustion products adjacent the underside of the slag tap orifice to retain the slag and iron in the hearth; and means for initiating the tapping of molten slag comprising means for stopping or reducing the burner output and means for reducing the pressure in the quenching chamber relative to that in the gasifier vessel; the improvement which comprises means for supplying a secondary supply of combustion-sustaining gas comprising at least some of the oxygen required for combustion at the burner in the quenching chamber, from a position within said quenching chamber above the level of a body of quenching liquid to be held therein and remote from the burner in said quenching chamber.

2. Apparatus as claimed in claim 1, wherein said supplying means is in the form of a tubular annulus provided with a plurality of port holes equi-spaced around its surface.

3. Apparatus as claimed in claim 1, wherein supplying means is disposed adjacent the wall of the quench chamber adjacent the level of a body of quenching liquid to be held therein.

4. Apparatus as claimed in claim 2, wherein the tubular annulus is shielded from slag which falls during a tapping operation in the operation of the gasifier.

5. Apparatus as claimed in claim 1, wherein said burner is a nozzle mixing ring type burner.

6. Apparatus as claimed in claim 5, wherein said burner comprises separate chambers for a fuel gas and for a primary air supply, each chamber having at least one inlet, and a plurality of outlet ports arranged around the inner periphery of the ring.

7. Apparatus as claimed in claim 5, wherein the inner periphery of the ring is provided with sloping walls through which said ports are formed arranged in use to provide combustion streams of fuel gas and primary air supply in the space defined by the ring.

8. In operation of a coal slagging gasifier in which coal or other carbonaceous fuel is introduced into the top of a column-like gasifying vessel and is gasified under high pressure and temperature by means of oxygen and steam introduced near a fuel bed through tuyeres, the gasification process producing a residual ash which collects as a molten slag and iron in a hearth of the gasifier vessel from which it is periodically discharged downwardly through a slag tap orifice in the hearth into water contained in a quenching chamber arranged so that a pool of molten slag and iron is maintained in the hearth by directing hot combustion products from a burner located within the quench chamber adjacent the underside of the slag tap orifice up the tap orifice to retain the slag and iron in the hearth, the tapping of the molten slag and iron being initiated and controlled by stopping or reducing the burner output and reducing the pressure in the quenching chamber by controlled venting to atmosphere through a venting system so as to produce a differential pressure between the quenching chamber and the gasifier vessel, the improvement wherein a secondary supply of combustion-sustaining gas containing at least some of the oxygen required for combustion at the burner is provided from a position within the chamber above the level of water therein and remote from the burner, whereby the flow path of the combustion-sustaining gas is arranged to circulate in a space in the quench chamber between the slag tap and the water level and to provide a layer of gas intermediate of the walls of the chamber and the products of combustion from the burner, and also whereby the upward flow towards the slag tap orifice of the combustion-sustaining gas restricts the downward flow of the combustion products from the burner and cools the quenching chamber walls.

9. Operation as claimed in claim 8, wherein the combustion sustaining gas contains from 10–90% of the oxygen required for combustion at the burner.

10. Operation as claimed in claim 8, wherein the combustion sustaining gas is a mixture of carbon dioxide and oxygen.

11. Operation as claimed in claim 8, wherein the combustion sustaining gas is air.

12. Operation as claimed in claim 8, wherein the combustion sustaining gas is supplied from positions adjacent the walls of the chamber and immediately above the water level.

13. Operation as claimed in claim 8, wherein said combustion sustaining gas is supplied at about ambient temperature.

14. Operation of a coal slagging gasifier, as claimed in claim 8, including a burner adjacent the underside of the slag removal orifice within the quenching chamber, and means for supplying said secondary supply of combustion-sustaining gas to the burner in a flow path which circulates the space in the chamber, said combustion-sustaining supply means being arranged within the chamber above the water level and remote from the burner, and wherein the supply means is in the form of a tubular annular provided with a plurality of port holes equi-spaced around its surface and wherein the burner is a nozzle mixing ring type burner comprising an annular body having separate fuel gas and primary air annular passages, each passage having at least one inlet for supplying fuel gas and primary air respectively thereto, and a plurality of outlet ports arranged around the inner peripheral wall of the burner body and communicating with respective passages and through which ports streams of fuel gas and primary air pass and mix in the central space defined by the annular body, and wherein said inner wall slopes downwardly and outwardly away from the top of the body.

* * * * *